US012264464B2

(12) United States Patent
Romanowski et al.

(10) Patent No.: US 12,264,464 B2
(45) Date of Patent: Apr. 1, 2025

(54) CONNECTION BODY FOR A FLUSH-MOUNTED INSTALLATION BODY

(71) Applicant: Grohe AG, Hemer (DE)

(72) Inventors: Carsten Romanowski, Iserlohn (DE); Nicolai Malert, Fröndenberg (DE)

(73) Assignee: GROHE AG, Hemer (DE)

( * ) Notice: Subject to any disclaimer, the term of this patent is extended or adjusted under 35 U.S.C. 154(b) by 0 days.

(21) Appl. No.: 17/917,328

(22) PCT Filed: Mar. 25, 2021

(86) PCT No.: PCT/EP2021/057738
§ 371 (c)(1),
(2) Date: Oct. 6, 2022

(87) PCT Pub. No.: WO2021/204552
PCT Pub. Date: Oct. 14, 2021

(65) Prior Publication Data

US 2024/0287773 A1 Aug. 29, 2024

(30) Foreign Application Priority Data

Apr. 8, 2020 (DE) ..... 102020109767.0

(51) Int. Cl.
*E03C 1/02* (2006.01)

(52) U.S. Cl.
CPC ..... *E03C 1/021* (2013.01)

(58) Field of Classification Search
CPC ..... E03C 1/021
See application file for complete search history.

(56) References Cited

U.S. PATENT DOCUMENTS 8,231,818 B2 * 7/2012 Bamber ..... G05D 16/2024 137/625.2
2007/0032323 A1 * 2/2007 Yoshida ..... F16H 7/0848 474/110
2008/0282965 A1 * 11/2008 Crano ..... B60C 5/02 116/34 R
2011/0042938 A1 * 2/2011 Gallagher ..... F16L 39/00 285/245
2013/0241196 A1 * 9/2013 Armbruster ..... E03C 1/04 285/55
2016/0265689 A1 * 9/2016 Sørensen ..... F16K 37/005
2017/0219152 A1 * 8/2017 Petrou ..... F16L 27/087
(Continued)

FOREIGN PATENT DOCUMENTS

DE 43 13 599 10/1994
WO 2019/076311 4/2019

OTHER PUBLICATIONS

International Search Report dated Jul. 12, 2021 in International (PCT) Application No. PCT/EP2021/057738.

*Primary Examiner* — Patrick C Williams
(74) *Attorney, Agent, or Firm* — Wenderoth, Lind & Ponack, L.L.P.

(57) ABSTRACT

A connection body (1) for a flush-mounted installation body (2), comprising:
a) a base body (3), which is at least partially made of plastic, and
b) at least one connection (4) for a fluid line, wherein the at least one connection (4) is at least partially made of metal and is at least partially cast into the base body (3);
a flush-mounted installation body (2) comprising the connection body (1); and
a method for manufacturing the connection body (1).

6 Claims, 3 Drawing Sheets

(56) References Cited

U.S. PATENT DOCUMENTS

| | | | | |
|---|---|---|---|---|
| 2018/0265342 | A1* | 9/2018 | Smeller | B67D 1/0045 |
| 2019/0082526 | A1* | 3/2019 | Namburu | H05H 1/28 |
| 2020/0318749 | A1 | 10/2020 | Zhu | |

* cited by examiner

CONNECTION BODY FOR A FLUSH-MOUNTED INSTALLATION BODY

This invention relates to a connection body for a flush-mounted installation body, to a flush-mounted installation body for a sanitary faucet and to a method of manufacturing a connection body for a flush-mounted installation body. Such flush-mounted installation bodies can be secured in particular inside a wall opening, a recess in a wall or at any other support. Such flush-mounted installation body have proved particularly useful for recessed walls and pre-wall systems.

Flush-mounted installation body are used to secure a functional unit in a wall or beam. The functional unit may include a thermostatic cartridge and/or a valve. By means of the thermostatic cartridge, a cold water and a hot water can be mixed to form a mixed water having a desired mixed-water temperature, wherein the valve can be used to control a withdrawal quantity of the mixed water. At least one mixed-water line can be connected to the flush-mounted installation body, via which the mixed water can be supplied to the sanitary faucet, such as a hand shower, overhead shower, nozzle, spout and/or the like at a shower and/or bathtub. The cold-water connection is typically connected to a cold-water service connection via appropriate piping and the hot-water connection is typically connected to a hot-water service connection via appropriate piping. The aforementioned water connections are formed in a connection body that is made of brass to comply with the strength requirements of the water connections. However, the brass used results in high the manufacturing costs of the connection bodies.

Therefore, the invention addresses the problem of solving at least a part of the issues described with reference to the prior art and, in particular, of providing a connection body for a flush-mounted installation body, the connections of which satisfy the strength requirements and which can still be manufactured at low cost. Furthermore, a flush-mounted installation body for a sanitary faucet with a connection body is to be specified, the connections of which comply with the strength requirements and which can also be manufactured at low cost. In addition, a method is also to be specified for producing a connection body, whose connections satisfy the strength requirements and which, at the same time, can be manufactured at low cost.

These are solved by a connection body, a flush-mounted installation body and a method having the features of the independent claims. Further advantageous embodiments of the invention are specified in the dependent claims. It will be appreciated that the features listed individually in the dependent claims may be combined in any technologically useful manner and define further embodiments of the invention. In addition, the features indicated in the claims are further specified and explained in the description, wherein further preferred embodiments of the invention are illustrated.

A connection body for a flush-mounted installation body having at least the components listed below contributes to solving the problem:

a) a base body, which is at least partially made of plastic, and b) at least one connection for a fluid line, wherein the at least one connection is at least partially made of metal and is at least partially cast into the base body.

The connection body can be used in particular for a flush-mounted installation body. Such flush-mounted installation bodies are used in particular for sanitary faucets that are used in connection with showers and/or bathtubs. The sanitary faucets may be, in particular, water outlets, hand showers, overhead showers, nozzles, and/or the like. Such flush-mounted installation bodies are regularly secured inside a wall opening, a recess in a wall or any other support and are used to mount a functional unit. The functional unit comprises in particular a mixing valve, for instance of the thermostatic mixing valve type, and/or at least one valve. The mixing valve can be used to mix the cold water and the hot water to form a mixed water having a desired mixed-water temperature. The cold water can have a cold-water temperature which is in particular at most 25° C. (Centigrade), preferably 1° C. to 25° C., particularly preferably 5° C. to 20° C. The hot water can have a hot-water temperature that is in particular at most 90° C., preferably 25° C. to 90° C., particularly preferably 55° C. to 65° C. The mixed water can be supplied by the mixing valve, for instance, using at least one line in the functional unit to the at least one valve, by means of which a withdrawal quantity of the mixed water can be controlled via the sanitary faucet. In particular, the functional unit is at least partially arranged in a mounting space of a housing of the flush-mounted installation body and/or is essentially cylindrical in shape.

For instance, the housing may have a lower shell and an upper shell that can be interconnected. In particular, the lower shell is lid-shaped such that a front opening of the upper shell can be closed (liquid-tight) by means of the lower shell. For this purpose, the lower shell can have first fastening lugs, which extend in particular radially outwards. The upper shell, on the other hand, is in particular tubular, i.e., the interior of the upper shell forms a mounting space for the functional unit. In addition, the top shell may include second fastening lugs that may also extend in the radial direction. The lower shell and the upper shell can be screwed together, in particular using the first fastening lugs and the second fastening lugs. Additionally, or alternatively, the lower shell and/or the upper shell may have snap arms, which can be used to latch the lower shell to the upper shell.

The connection body has a base body that is at least partially made of plastic. The base body can be a plastic injection-molded part, for instance. In this way, all forming elements, sealing surfaces and/or screw points, etc. can be formed during the manufacture of the connection body. Furthermore, the connection body has at least one connection for a fluid line. In particular, this may mean that the fluid line can be attached to the at least one connector such that a fluid can flow from a fluid channel of the connector body into the fluid line or vice versa. In particular, the connection body may have at least one first connection for a supply line (for instance, for the cold water and/or the hot water) and at least one second connection for a discharge line (for instance, for the mixed water). Furthermore, the connection body can have a (through) opening, in which the functional unit can be fastened. In particular, a service connection for the cold water or hot water can be connected to the at least one first connection and/or a mixed-water line for discharging the mixed water to the sanitary faucet can be connected to the at least one second connection.

Further, the connection body may have, particularly at a circumferential surface, a cold-water connection, a hot-water connection, a first mixed-water connection, a second mixed-water connection, and a third mixed-water connection. The flush-mounted installation body can be connected in particular to the service connection for the cold water via the cold-water connection and to the service connection for the hot water via the hot-water connection. The cold water supplied via the service connection for the cold water and the hot water supplied via the service connection for the hot water can, in particular, be routed to the mixing valve of the functional unit and mixed there to form a mixed water having a desired mixed-water temperature. The mixed water can then be supplied to a first valve, a second valve and a third valve of the functional unit, by means of which an outflow of the mixed water via the first mixed-water connection, the second mixed-water connection and/or the third mixed-water connection can be controlled. A first sanitary faucet can be connected to the first mixed-water connection, a second sanitary faucet can be connected to the second mixed-water connection, and/or a third sanitary faucet can be connected to the third mixed-water connection.

Further, the connection body may have a longitudinal axis, a first connection axis perpendicular to the longitudinal axis, and a second connection axis perpendicular to the longitudinal axis and to the first connection axis, wherein the cold-water connection, the hot-water connection, and the first mixed-water connection open into the connection body in parallel to the first connection axis, and wherein the second mixed-water connection and the third mixed-water connection open into the connection body in parallel to the second connection axis. This embodiment makes it possible to avoid intersecting a supply line of the cold water and/or the hot water with at least one discharge line for the mixed water possible, thus facilitating the installation of the flush-mounted installation body in the wall or partition.

In addition, the first mixed-water connection may be disposed at an end of the connection body opposite from the cold-water connection and the hot-water connection, wherein the second mixed-water connection may be disposed at an end of the connection body opposite from the third mixed-water connection.

The connection body can be arranged at least partially in the mounting space of the housing. By connecting the lower shell to the upper shell, the connection body can also be secured in the mounting space, for instance. The connection body is fastened in the mounting space in particular by bracing the connection body between the lower shell and the upper shell. This design means that the flush-mounted installation body can be manufactured using little assembly effort, in particular also in automated production lines. The at least one connector is at least partially made of metal. The metal can be brass or a brass alloy, for instance. The at least one connector further comprises, in particular, at least one attachment structure for the fluid line. The at least one attachment structure can be in particular a thread. The attachment structure can be used to secure the fluid line in particular to the at least one connection. In addition, the at least one connection is at least partially molded into the base body. Owing to the at least partial encapsulation of the at least one connection, the at least one connection is firmly connected to the base body. By at least partially molding the at least one connection made of metal into the base body made of plastic, metal can be saved for the base body, thus reducing the manufacturing costs of the connection body. At the same time, the at least one connection has the required strength.

The at least one connection can be designed as a sleeve. In particular, the at least one attachment structure may be formed on the sleeve or at an inner circumferential surface of the sleeve. The sleeve can be a threaded sleeve, for instance. Thus, in particular, the fluid line can be attached to the sleeve. In particular, the sleeve is at least partially tubular. In addition, the sleeve may at least partially define and/or form a fluid channel extending through the sleeve and/or the base body. Furthermore, the sleeve can have a (circumferential) flange section at one (outer) longitudinal end.

In particular, the sleeve cannot extend completely through a wall of the base body. In particular, this may mean that a fluid channel extending through the wall of the base body does not have to be formed entirely by the sleeve.

The at least one connector can have at least one rib which is used to anchor the at least one connector in the base body. In particular, the at least one connection may have a plurality of ribs. Further, the at least one rib may be formed on an outer circumferential surface of the at least one connection or sleeve. In particular, the at least one rib can extend (completely) around the outer circumferential surface. By means of the at least one rib, the at least one connection is connected to the connection body or the base body in particular in a form-fitting manner.

The base body can be designed to be at least partially annular. Here, for instance, the base body may have an inner diameter of 50 mm (millimeters) to 300 mm, an outer diameter of 60 mm to 310 mm, a ring width (in a longitudinal direction in parallel to a longitudinal axis) and/or a ring thickness (in a radial direction perpendicular to the longitudinal direction or longitudinal axis) of 5 mm to 50 mm. It should be made clear here that the base body does not necessarily have to be circular, but can also have a polygonal, square or rectangular cross-section, for instance. This design can be used to save material, such as (cast) metal for the connection ring, particularly in comparison with conventional cup-shaped connection bodies, i.e., the connection ring can be made particularly easily. In addition, the installation space required for the connection ring in the housing of the flush-mounted installation body is reduced.

The connection body may have at least one reinforcement. The at least one reinforcement can be a metal element, for instance, which is used in particular to increase the strength of the connection body and/or is formed in the manner of a (metal) wire. The at least one reinforcement can also be cast into the base body.

The at least one reinforcement can be arranged in at least one opening of the base body. The at least one opening can, for instance, be designed in the manner of a groove and/or gap. Furthermore, the at least one opening can be formed, for instance, on an end face of the base body and/or on a (particularly outer) circumferential surface of the base body. Furthermore, the at least one opening can be used for bonding the connection body to the housing of the flush-mounted installation body, for instance. Through the at least one opening, for instance, any leakage of an adhesive can be prevented. Bonding of the base body of the connection body, which is at least partially made of plastic, for instance, to a housing of the flush-mounted installation body is also facilitated by the design of the base body made of plastic, because the bonding surfaces of the components to be bonded are not made of different materials, but are all at least partially made of plastic.

The at least one reinforcement may be annular in shape. The at least one reinforcement does not necessarily have to be circular either, but can also have a polygonal, square or rectangular cross-section, for instance. The shape of the at least one reinforcement can in particular be adapted to a shape of the base body.

The at least one reinforcement may be prestressed. To this end, the at least one reinforcement may be heated prior to its placement in the at least one opening, for instance, wherein the pre-stress results from cooling and shrinkage of the at least one reinforcement in the at least one opening. In particular, the prestress can prevent overloading of the connection body by tensile forces and/or compressive forces at the at least one connection.

In accordance with another aspect, a flush mounted installation body for a sanitary faucet is also proposed, comprising at least the components listed below:

a) a housing having a mounting space for a functional unit, and b) a connection body arranged at least partially in the mounting space.

For further details, please refer to the description of the connection body.

The connection body or the flush mounted installation body may be used to secure a functional unit in a wall or at a support, wherein the functional unit may preferably include a thermostatic cartridge and/or valve.

According to yet another aspect, a method of manufacturing a connection body for a flush-mounted installation body is proposed, comprising at least the steps outlined below:

i. providing a casting mold;

ii. arranging at least one connection for a fluid line in the casting mold, wherein the at least one connection is at least partially made of metal; and iii. at least partial encapsulation of the at least one connection with plastic to produce a base body of the connection body.

The casting mold is a hollow body into which a liquid plastic melt can be poured. The mold can be at least partially openable to make a mounting space for the liquid plastic melt of the mold at least partially accessible. For this purpose, the casting mold can be in particular of multi-part design. In step ii. at least one terminal is arranged in the mounting space, and the at least one terminal is subsequently at least partially encapsulated with plastic in step iii. to produce the base body of the connection body. The molten plastic then cools and solidifies.

Prior to step iii. at least one reinforcement may be placed in the mold.

After step iii. at least one reinforcement can be arranged in at least one opening of the base body.

The at least one reinforcement may be heated prior to its placement in the at least one opening. For instance, the at least one reinforcement may be heated to a temperature above 100° C. (Centigrade). Subsequently, the at least one reinforcement is arranged in the at least one opening and cools down there. This shrinks the at least one reinforcement in the at least one opening to prestress the at least one reinforcement.

For further details regarding the process, please refer to the description of the connection body.

The invention and the technical environment are explained in more detail below with reference to the figures. It should be noted that the figures show particularly preferred variants of the embodiment of the invention, but the invention is not limited thereto. The same reference numerals are used for the same components in the figures. In an exemplary and schematic manner FIG. 1 shows an exploded view of a flush mounted installation body;

Figure 1:
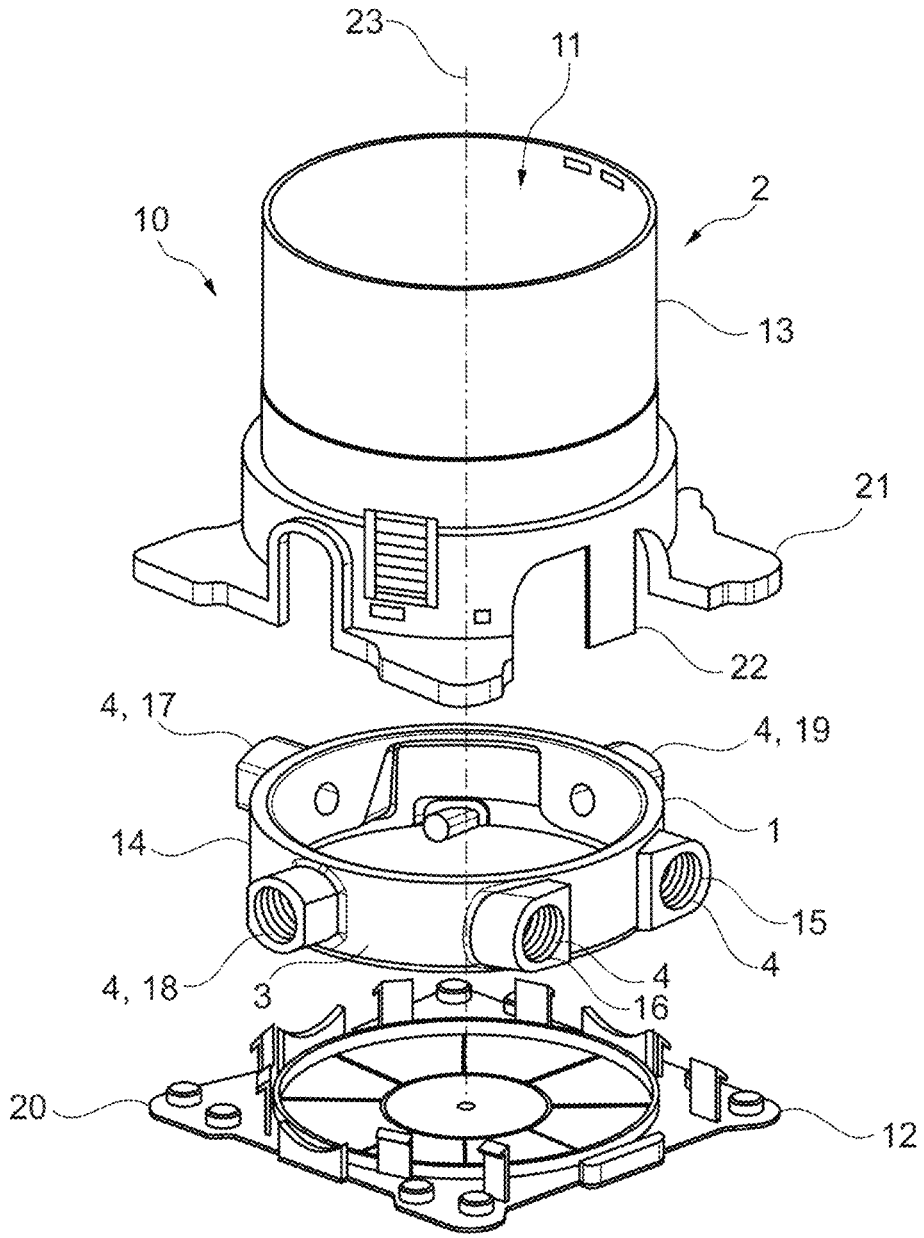

FIG. 1 shows an exploded view of a flush mounted installation body 2 with a housing 10 comprising a lower shell 12 and an upper shell 13. The lower shell 12 is lid-shaped and the upper shell 13 is tubular. The housing 10 also has a mounting space 11 for a functional unit (not shown here). In addition, the flush-mounted installation body 2 has a connection body 1 having a base body 3, which is annular in shape. The connection body 1 has two connections 4 in the form of a cold-water connection 15 and a hot-water connection 16 on a circumferential surface 14 of the base body 3. In addition, the circumferential surface 14 of the base body 3 has a connection 4 in the form of a first mixed-water connection 17, a connection 4 in the form of a second mixed-water connection 18 and a connection 4 in the form of a third mixed-water connection 19. When mounting the flush-mounted installation body 2, the connection body 1 is placed on the lower shell 12 and then the upper shell 13 is connected to the lower shell 12. For this purpose, the lower shell 12 has first fastening lugs 20 and the upper shell 13 has second fastening lugs 21, which can be used to bolt the lower shell 12 to the upper shell 13. Furthermore, snap arms 22 are formed at the top shell 13, which extend in parallel to a longitudinal axis 23 of the flush-mounted installation body 2. The orientation of the longitudinal axis 23 is defined by the extension of the tubular section of the upper shell 13 and/or the annular connection body 1. The snap arms 22 can be latched to the lower shell 12. By connecting the lower shell 12 to the upper shell 13, the connection body 1 is secured in the mounting space 11.

Figure 2:
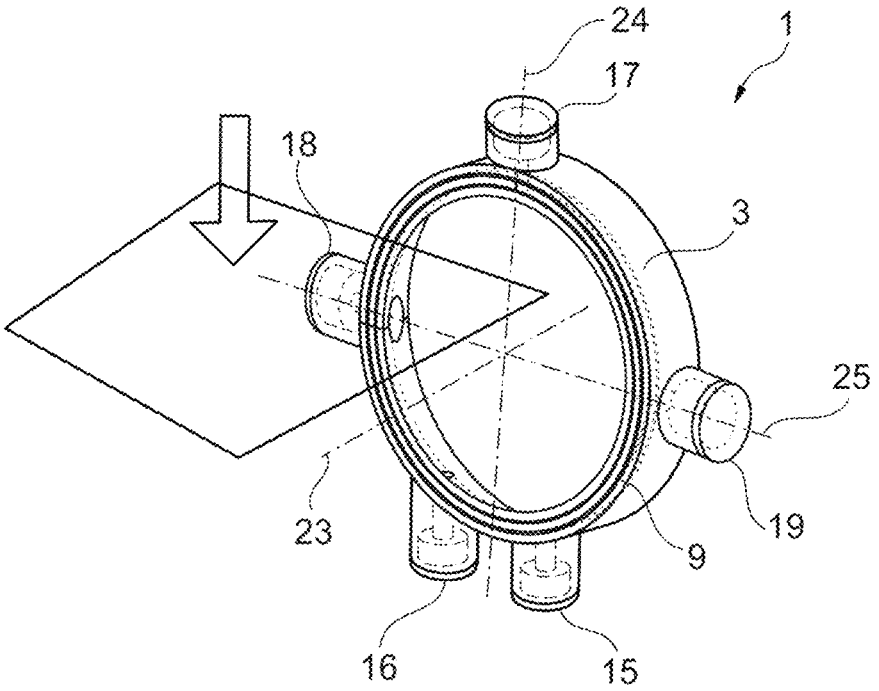
FIG. 2 shows a perspective view of a connection body of a flush mounted installation body.

FIG. 2 shows a perspective view of the connection body 1. The connection body 1 has a first connection axis 24 perpendicular to the longitudinal axis 23, and a second connection axis 25 perpendicular to the longitudinal axis 23 and to the first connection axis 24. The cold-water connection 15, the hot-water connection 16 and the first mixed-water connection 17 open into the connection body 1 or the base body 3 of the connection body 1 in parallel to the first connection axis 24. Furthermore, the second mixed-water connection 18 and the third mixed-water connection 19 open into the connection body 1 and the base body 3 of the connection body 1, respectively, in parallel to the second connection axis 25. In addition, the first mixed-water connection 17 is arranged at an end of the connection body 1 opposite from the cold-water connection 15 and the hot-water connection 16, and the first mixed-water connection 17 is arranged at an end of the connection body 1 opposite from the third mixed-water connection 19. The functional unit, which is not shown here, can be attached to the connection body 1 in such a way that the cold-water connection 15, the hot-water connection 16, the first mixed-water connection 17, the second mixed-water connection 18 and the third mixed-water connection 19 are connected to the functional unit without leakage.

Figure 3:
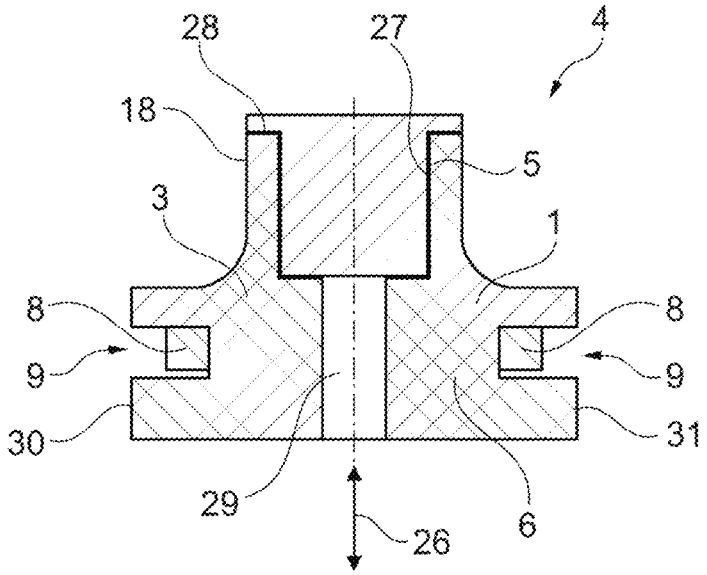
FIG. 3 shows a sectional view of a first embodiment variant of a connection of the connection body.

FIG. 3 shows a sectional view of a first embodiment variant of a connection 4 along the sectional plane shown in FIG. 2. The connection 4 is thus the second mixed-water connection 18. The port 4 extends outwards from the base body 3 of the connection body 1 in a radial direction 26, i.e., perpendicular to the longitudinal axis 23 shown in FIG. 2. The base body 3 is a plastic injection molded part formed from plastic. The connection 4 has a sleeve 5 cast into the base body 3. The sleeve 5 has a female thread on an inner circumferential surface 27 for a fluid line not shown here, and a flange section 28 at a longitudinal end. A fluid channel 29 extends through the sleeve 5 and a wall 6 of the base body 3 in the radial direction 26, through which fluid channel fluid can flow into and/or out of the connection body 1 through the connection 4. As can be seen in FIG. 3, the sleeve 5 does not extend completely through the wall 6 of the base body 3. The base body 3 of the connection body 1 has one opening 9 each in a first end face 30 and a second end face 31, respectively. The openings 9 are each formed in the manner of a groove or gap and, as can be seen in FIG. 2, extend annularly along the end faces 30, 31. A reinforcement 8 is arranged in each of the openings 9, which are designed in the manner of metal reinforcement rings. The reinforcements 8 have been heated before being placed in the openings 8, to generate a prestressing force that is directed inward in the radial direction 26 after they are placed and cooled in the openings 9. The other connections 4, 16, 17, 18, 19 of the connection body 1 shown in FIGS. 1 and 2 can be designed in accordance with the second mixed water connection 18 shown here.

Figure 4:
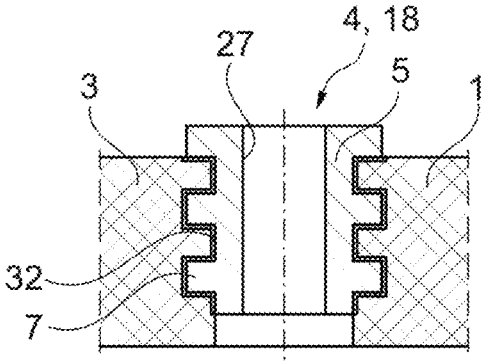
FIG. 4 shows a sectional view of a second embodiment variant of a connection of the connection body at a first temperature.

FIG. 4 shows a sectional view of a second embodiment variant of a connection 4 at a first temperature along the sectional plane shown in FIG. 2. The second embodiment variant of the connection 4 is thus also the second mixed-water connection 18 of the base body 3 of the connection body 1 shown in FIG. 2. The sleeve 5 is also made of metal and has a thread on the inner circumferential surface 27 for a fluid line (not shown here). Furthermore, the sleeve 5 is cast into the base body 3. In addition, in contrast to the first embodiment variant of the connector 4, the sleeve 5 has two circumferential ribs 7 on an outer circumferential surface 32, which are used to anchor the sleeve 5 in the base body 3 of the connection body 1. The other connections 4, 16, 17, 18, 19 of the connection body 1 shown in FIGS. 1 and 2 can be designed in accordance with the second mixed water connection 18 shown here. In addition, as in the first embodiment shown in FIG. 3, the base body 3 can have a reinforcement 8 arranged in openings 9. FIG. 4 shows the connection 4 at a room temperature, for instance at 18° C. (Celsius)-25° C. At the first temperature or at the room temperature, sealing surfaces 33 are formed between the sleeve 5 and the connection body 1, which are formed by all contact surfaces between the sleeve 5 and the connection body 1. This is a basic state after manufacturing.

Figure 5:
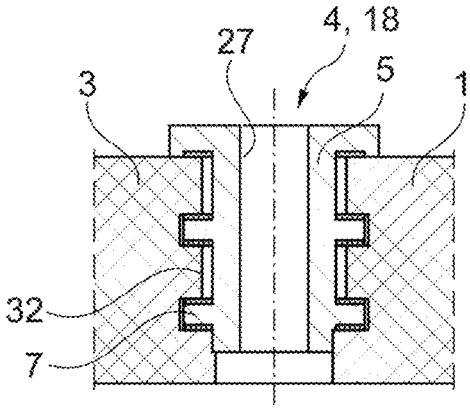
FIG. 5 shows a sectional view of the second embodiment of the connection of the connection body at a second temperature.

FIG. 5 shows the same sectional view as in FIG. 4 of the second embodiment variant of the connection 4 at a second temperature. The second temperature is greater than the first temperature. The connection body 1 expands more than the sleeve 5 when heated. Therefore, the sealing surfaces 33 between the sleeve 5 and the connection body 1 in FIG. 5 are formed only in the direction of the second connection axis 25. The remaining pairs of surfaces lose contact and thus their tightness. Overall, the connection remains tight.

Figure 6:
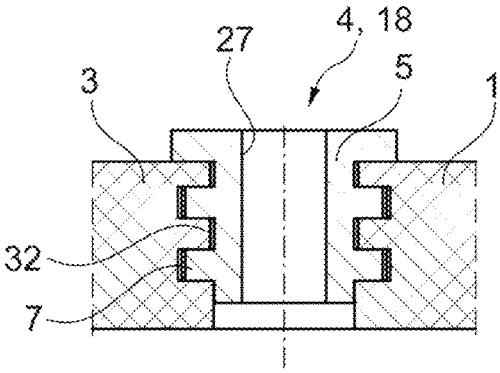
FIG. 6 shows a sectional view of the second embodiment of the connection of the connection body at a third temperature.

FIG. 6 shows the same sectional view as in FIGS. 4 and 5 of the second embodiment variant of the connection 4 at a third temperature. In FIG. 6, the connection body 1 with the sleeve 5 is in a cooling phase, in which the third temperature is between the first temperature and the second temperature. The connection body 1 shrinks faster or more than the sleeve 5. Therefore, the sealing surfaces 33 between the sleeve 5 and the connection body 1 in FIG. 6 are formed only in one direction transverse to the second connection axis 25. The remaining pairs of surfaces between the sleeve 5 and the connection body 1 (in the direction of the second connection axis 25) lose contact and thus their tightness. Overall, however, the connection remains tight.

This invention provides a connection body that is inexpensive to manufacture and whose terminals have a required strength.

LIST OF REFERENCE NUMERALS AND TERMS

1 connection body
2 flush-mounted installation body
3 base body
4 connection
5 sleeve
6 wall
7 rib
8 reinforcement
9 opening
10 body
11 mounting space
12 lower shell
13 upper shell
14 circumferential surface
15 cold-water outlet
16 hot-water outlet
17 first mixed-water connection
18 second mixed-water connection
19 third mixed-water connection
20 first fastening lug
21 second fastening lug
22 snap arm
23 longitudinal axis
24 first connection axis
25 second connection axis
26 radial direction
27 inner circumferential surface
28 flange section
29 fluid channel
30 first end face
31 second end face
32 outer circumferential surface
33 sealing surface

The invention claimed is:

1. A method for manufacturing a connection body (1) for a flush-mounted installation body (2), comprising:

i. providing a casting mold;

ii. arranging at least one connection (4) for a fluid line in the casting mold, wherein the at least one connection (4) is at least partially made of metal;

iii. heating at least one metal reinforcement ring to obtain at least one prestressed metal reinforcement ring (8);

iv. arranging the at least one prestressed metal reinforcement ring (8) in the casting mold; and v. at least partially encapsulating the at least one connection (4) with plastic to produce a base body (3) of the connection body (1).

2. The method according to claim 1, further comprising, after the step v, arranging the at least one prestressed metal reinforcement ring (8) in at least one opening (9) of the base body (3).

3. The method according to claim 1, further comprising cooling and shrinking the at least one prestressed metal reinforcement ring (8).

4. A method for manufacturing a connection body (1) for a flush-mounted installation body (2), comprising:

i. providing a casting mold;

ii. arranging at least one connection (4) for a fluid line in the casting mold, wherein the at least one connection (4) is at least partially made of metal;

iii. heating at least one reinforcement;

iv. arranging the at least one reinforcement in the casting mold; and v. at least partially encapsulating the at least one connection (4) with plastic to produce a base body (3) of the connection body (1).

5. The method according to claim 4, wherein the at least one reinforcement is a metal.

6. The method according to claim 4, wherein the at least one reinforcement is a metal ring.

* * * * *